US010192675B2

(12) United States Patent
Hsieh et al.

(10) Patent No.: US 10,192,675 B2
(45) Date of Patent: Jan. 29, 2019

(54) PULSE TRANSFORMER

(71) Applicant: Tai-Tech Advanced Electronics Co., Ltd., Taoyuan Hsien (TW)

(72) Inventors: Ming Yen Hsieh, Taoyuan Hsien (TW); Hsiang Chung Yang, Taoyuan Hsien (TW)

(73) Assignee: Tai-Tech Advanced Electronics Co., Ltd., Yangmei Taoyuan Hsien (TW)

( * ) Notice: Subject to any disclaimer, the term of this patent is extended or adjusted under 35 U.S.C. 154(b) by 148 days.

(21) Appl. No.: 15/237,822

(22) Filed: Aug. 16, 2016

(65) Prior Publication Data

US 2018/0053594 A1 Feb. 22, 2018

(51) Int. Cl.
*H01F 27/28* (2006.01)
*H01F 27/29* (2006.01)

(52) U.S. Cl.
CPC ..... *H01F 27/292* (2013.01); *H01F 27/2823* (2013.01)

(58) Field of Classification Search
USPC ..... 336/192, 221, 170
See application file for complete search history.

(56) References Cited

U.S. PATENT DOCUMENTS

| | | | | |
|---|---|---|---|---|
| 5,805,431 | A | 9/1998 | Joshi et al. | |
| 6,242,996 | B1 * | 6/2001 | Sato | H01F 17/045 336/174 |
| 6,373,366 | B1 | 4/2002 | Sato et al. | |
| 7,889,045 | B2 | 2/2011 | Tomonari et al. | |
| 9,349,526 | B2 | 5/2016 | Takagi et al. | |
| 2005/0052267 | A1 * | 3/2005 | Singu | H01F 17/045 336/83 |
| 2014/0292465 | A1 * | 10/2014 | Takagi | H01F 27/292 336/192 |
| 2015/0287520 | A1 * | 10/2015 | Takagi | H01F 27/29 336/170 |
| 2016/0172093 | A1 * | 6/2016 | Fan | H01F 27/2828 336/220 |

* cited by examiner

*Primary Examiner* — Elvin G Enad
*Assistant Examiner* — Kazi Hossain
(74) *Attorney, Agent, or Firm* — Charles E. Baxley

(57) ABSTRACT

A pulse transformer includes a drum core having a winding core, two flanges on end portions of the winding core and each having a notch formed in the upper portion, two terminal electrodes and a center tap disposed on one of the flanges, two further terminal electrodes and another center tap disposed on the other flange, a coil includes four wires wound around the winding core of the drum core and connected to the terminal electrodes and the center taps, two of the wires are wound in one direction, and the other wires are wound in another direction, two of the wires cross each other at the inner surface of one of the flanges, and the other wires cross each other at the inner surface of the other flange.

2 Claims, 2 Drawing Sheets

PULSE TRANSFORMER

BACKGROUND OF THE INVENTION

1. Field of the Invention

The present invention relates to a transformer, and more particularly to a surface mount pulse transformer or the like including an improved structure or configuration that may be suitably and effectively made or manufactured with an automatic winding machine for allowing the pulse transformer to have a product of greatly increased and excellent accuracy and precision and reliability.

2. Description of the Prior Art

Various kinds of typical pulse transformers have been developed and provided and widely used for isolating a differential signal at an input side (primary side) and a differential signal at an output side (secondary side), and will normally be mounted on a printed circuit board or the like at high density, and normally comprise a drum core, and one or more wires or windings to be wound around the drum core in order to form a surface-mount pulse transformer.

For example, U.S. Pat. No. 5,805,431 to Joshi et al., U.S. Pat. No. 6,373,366 to Sato et al., U.S. Pat. No. 7,889,045 to Tomonari et al., and U.S. Pat. No. 9,349,526 to Takagi et al. disclose several of the typical pulse transformers each comprising one or more wires or windings to be wound around a drum core in order to form a surface-mount pulse transformer and so as to be mounted on a printed circuit board at high density, and the wires or windings will normally be wound around the drum core with an automatic winding machine.

However, the drum core of the typical pulse transformers includes a structure or configuration that the wires or windings may not be easily and effectively wound around the drum core with an automatic winding machine, and/or the winding operation of the wires or windings onto the drum core will be affected or interfered with the structure or configuration of the typical pulse transformers such that the typical pulse transformers may not be effectively made or manufactured to have a product of an increased and excellent accuracy and precision and reliability.

The present invention has arisen to mitigate and/or obviate the afore-described disadvantages of the conventional pulse transformers.

SUMMARY OF THE INVENTION

The primary objective of the present invention is to provide a pulse transformer including an improved structure or configuration that may be suitably and effectively made or manufactured with an automatic winding machine for allowing the pulse transformer to have a product of greatly increased and excellent accuracy and precision and reliability.

In accordance with one aspect of the invention, there is provided a pulse transformer comprising a drum core including a winding core, a first flange and a second flange provided on end portions of the winding core respectively, the first and the second flanges each including an inner surface and an outer surface and an upper portion, the first and the second flanges each including a notch formed in the upper portion thereof and each of the notches being defined by a base surface, a first terminal electrode and a second terminal electrode provided on the upper portion of the first flange, a first center tap and a third terminal electrode and a fourth terminal electrode provided on the upper portion of the second flange, a second center tap provided on the upper portion of the first flange, the notch of the first flange being located between the second terminal electrode and the second center tap, and the notch of the second flange being located between the first center tap and the third terminal electrode, and a coil including a first wire, a second wire, a third wire and a fourth wire wound around the winding core of the drum core, the first wire including a first end portion connected to the second terminal electrode and a second end portion connected to the first center tap, the second wire including a first end portion connected to the second center tap and a second end portion connected to the third terminal electrode, the third wire including a first end portion connected to the first terminal electrode and a second end portion connected to the first center tap, the fourth wire including a first end portion connected to the second center tap and a second end portion connected to the fourth terminal electrode, and the first and the second wires being wound in a first direction as seen from the first flange toward the winding core and the second flange, and the third and the fourth wires being wound in a second direction as seen from the first flange toward the winding core and the second flange, the first and the fourth wires crossing each other at the inner surface of the first flange, and the second and the third wires crossing each other at the inner surface of the second flange. The formation and the provision of the notches in the flanges allows the wires to be suitably wound crossed each other, without being interfered with or by the flanges.

The first and the second flanges each include a chamfered portion provided in each side of the notch of the first and the second flanges respectively, and the formation and the provision of the chamfered portions of the flanges also allows the wires to be suitably wound crossed each other, without being interfered with or by the flanges. The winding core includes an upper surface, and the base surfaces of the first and the second flanges are flush with the upper surface of the winding core.

The notch of the first flange is formed through the first flange and formed between the inner and the outer surfaces of the first flange, and the notch of the second flange is formed through the second flange and formed between the inner and the outer surfaces of the second flange for preventing the windings of the wires to be interfered with or by the flanges.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
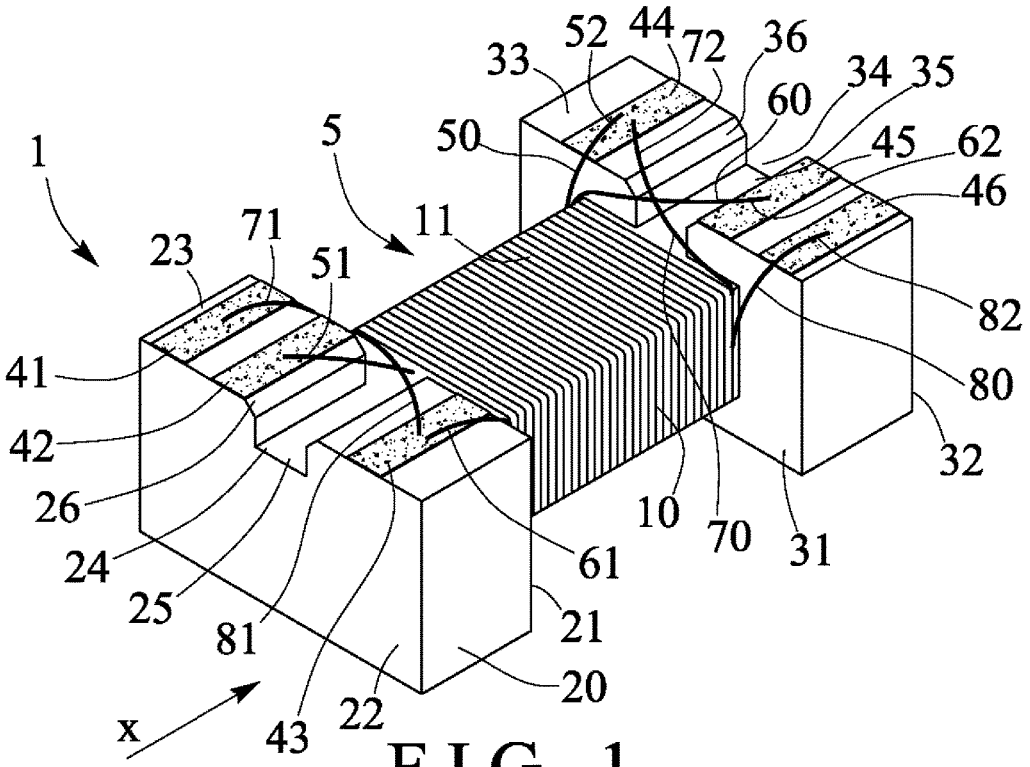
FIG. 1 is a perspective view of a pulse transformer in accordance with the present invention.
Figure 2:
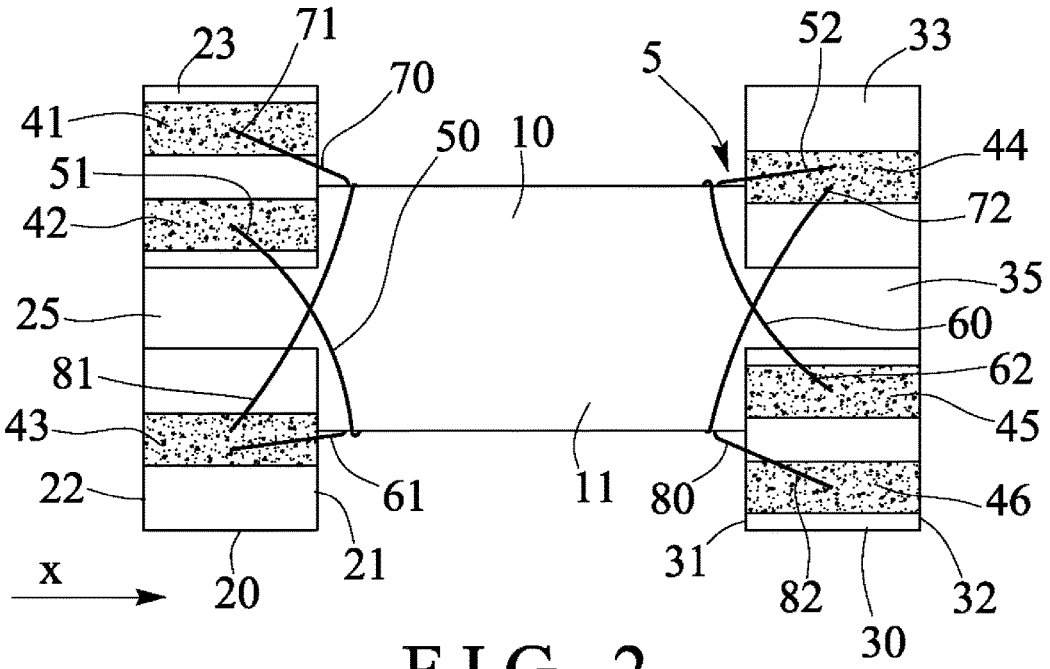
FIG. 2 is a top plan schematic view of the pulse transformer.

Referring to the drawings, and initially to FIGS. 1 and 2, a pulse transformer in accordance with the present invention comprises a drum core 1 including a winding core 10, and one or more (such as two) flanges 20, 30 formed or provided on the end portions of the winding core 10 respectively, the flanges 20, 30 each include an inner surface 2L 31 and an outer surface 22, 32 and an upper portion 23, 33, and the winding core 10 includes a dimension or width and/or height and/or cross section smaller than that of the flanges 20, 30 for allowing the flanges 20, 30 to be extended radially and outwardly beyond the winding core 10.

It is preferable that the winding core 10 includes a substantially parallelepiped structure or configuration having a square or rectangular cross section and having an upper surface 11. The flanges 20, 30 each include a recess or notch 24, 34 formed or provided in the upper portion or upper portion 23, 33 thereof and each defined by a base surface 25, 35 that is aligned with or flush with the upper surface 11 of the winding core 10. The notch 24 of the first flange 20 is formed through the first flange 20 and formed between the inner and the outer surfaces 21, 22 of the first flange 20; and the notch 34 of the second flange 30 is formed through the second flange 30 and formed between the inner and the outer surfaces 31, 32 of the second flange 30. It is further preferable that the flanges 20, 30 each include a tilted or inclined or rounded or chamfered portion 26, 36 formed or provided in each side of the notch 24, 34 thereof.

The winding core 10 includes a first terminal electrode 41, a second terminal electrode 42, and a second center tap 43 formed or provided on the upper portion 23 of the first flange 20, and a first center tap 44 and a third terminal electrode 45 and a fourth terminal electrode 46 formed or provided on the upper portion 33 of the second flange 30, in which the notch 24 of the first flange 20 is formed or provided and arranged or located between the second terminal electrode 42 and the second center tap 43, and the notch 34 of the second flange 30 is formed or provided and arranged or located between the first center tap 44 and the third terminal electrode 45.

A winding or coil 5 is arranged to be wound around the winding core 10 and/or the flanges 20, 30 of the drum core 1 in order to form a surface-mount pulse transformer, for example, the coil 5 includes four wires 50, 60, 70, 80 to be wound around the winding core 10 and/or the flanges 20, 30 of the drum core 1 in two layers, for example, the first and the second wires 50, 60 will be wound around the winding core 10 and/or the flanges 20, 30 of the drum core 1 in a bifilar winding arrangement and formed as the base or inner or first layer; and the third and the fourth wires 70, 80 will also be wound around the winding core 10 and/or the flanges 20, 30 of the drum core 1 in a bifilar winding arrangement and formed as the upper or outer or second layer.

It is preferable that the two layers of the coil 5 are arranged or wound in different directions, for example, the base or inner or first layer formed by the first and the second wires 50, 60 is wound in a first direction, such as clockwise as seen from the direction X that is viewed from the first flange 20 toward the winding core 10 and the second flange 30; and the upper or outer or second layer formed by the third and the fourth wires 70, 80 is wound in a second direction, such as counterclockwise as seen from the direction X that is viewed from the first flange 20 toward the winding core 10 and the second flange 30, such that the two layers of the coil 5 will be wound crossed each other, as best shown in FIG. 2, the first and the fourth wires 50, 80 will cross each other at the inner surface 21 of the first flange 20, and the second and the third wires 60, 70 will cross each other at the inner surface 31 of the second flange 30. The formation and the provision of the notches 24, 34 in the flanges 20, 30 allows the wires 50, 80; 60, 70 to be suitably wound crossed each other, without being interfered with or by the flanges 20, 30.

The first wire 50 includes a first terminal or end portion 51 connected or coupled to the second terminal electrode 42, and a second terminal or end portion 52 connected or coupled to the first center tap 44; the second wire 60 includes a first terminal or end portion 61 connected or coupled to the second center tap 43, and a second terminal or end portion 62 connected or coupled to the third terminal electrode 45; the third wire 70 includes a first terminal or end portion 71 connected or coupled to the first terminal electrode 41, and a second terminal or end portion 72 connected or coupled to the first center tap 44; the fourth wire 80 includes a first terminal or end portion 81 connected or coupled to the second center tap 43, and a second terminal or end portion 82 connected or coupled to the fourth terminal electrode 46.

The first and the second wires 50, 60 will be formed as the primary-side coil, and the third and the fourth wires 70, 80 will be formed as the secondary-side coil for the pulse transformer, the first and the second terminal electrodes 41, 42 will be formed as the balanced input and acted as the positive-side terminal electrode and the negative-side terminal electrode for the primary-side coil, and the third and the fourth terminal electrodes 45, 46 will be formed as the balanced input and acted as the positive-side terminal electrode and the negative-side terminal electrode for the secondary-side coil, and the first and the second center taps 44, 43 will be formed and acted as the center taps 44, 43 for the primary-side coil and the secondary-side coil respectively.

In operation, as also shown in FIGS. 1 and 2, the formation and the provision of the notches 24, 34 in the flanges 20, 30 allows the wires 50, 80; 60, 70 to be suitably wound crossed each other, without being interfered with or by the flanges 20, 30, and the formation and the provision of the chamfered portions 26, 36 of the flanges 20, 30 also allows the wires 50, 80; 60, 70 to be suitably wound crossed each other, without being interfered with or by the flanges 20, 30.

Figure 3:
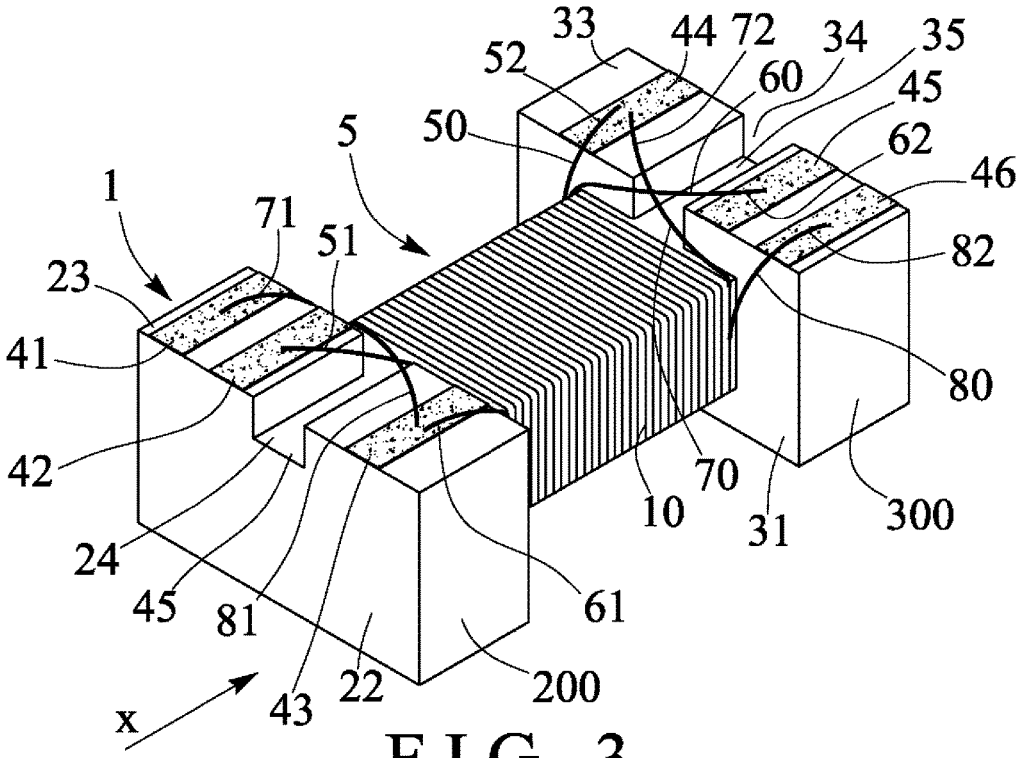
FIG. 3 is another perspective view similar to FIG. 1, illustrating the other arrangement of the pulse transformer.
Figure 4:
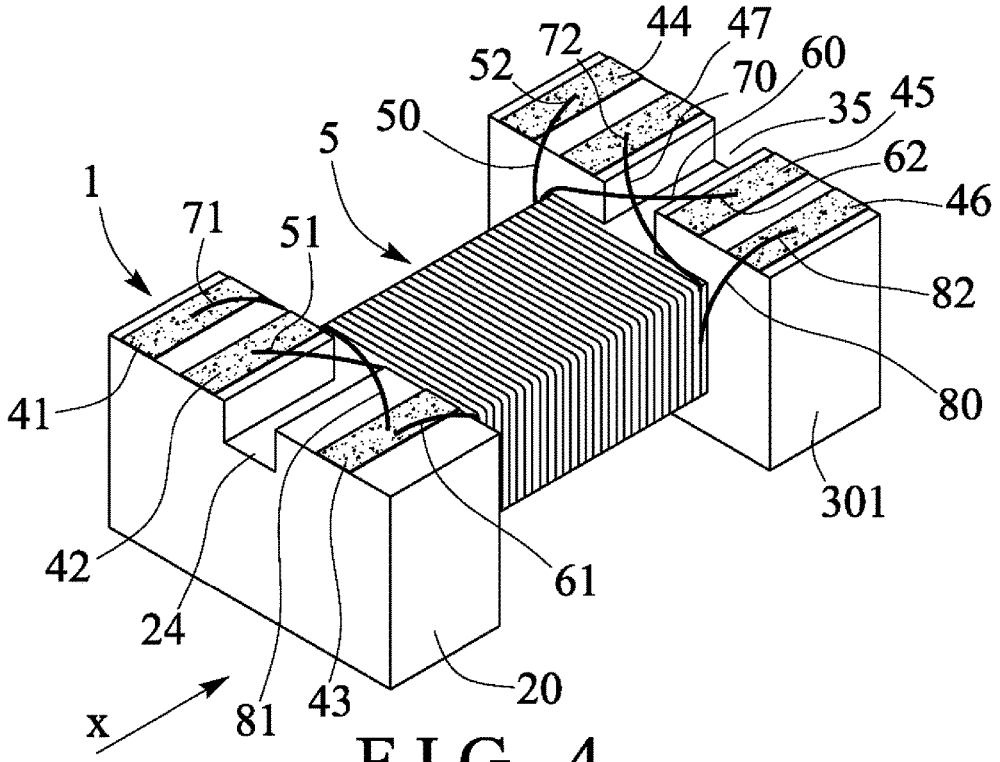
FIG. 4 is a further perspective view similar to FIGS. 1 and 3, illustrating the further arrangement of the pulse transformer.

Alternatively, as shown in FIG. 3, the flanges 200, 300 may have no rounded or chamfered portions formed therein; and as shown in FIG. 4, the second flange 301 may further include an auxiliary center tap 47 formed or provided on the upper portion 33 of the second flange 301 and arranged or located closer to the notch 34 of the second flange 301 than the first center tap 44.

Accordingly, the pulse transformer in accordance with the present invention includes an improved structure or configuration that may be suitably and effectively made or manufactured with an automatic winding machine for allowing the pulse transformer to have a product of greatly increased and excellent accuracy and precision and reliability.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A pulse transformer comprising:

a drum core including a winding core, a first flange and a second flange provided on end portions of said winding core respectively, said first and said second flanges each including an inner surface and an outer surface and an upper portion, said winding core including an upper surface, said first and said second flanges each including a notch formed in said upper portion thereof and each of said notches being defined by a base surface, said first and said second flanges each including a chamfered portion provided in each side of said notch of said first and said second flanges respectively, said base surfaces of said first and said second flanges being flush with said upper surface of said winding core, a first terminal electrode and a second terminal electrode provided on said upper portion of said first flange, a first center tap and a third terminal electrode and a fourth terminal electrode provided on said upper portion of said second flange, a second center tap provided on said upper portion of said first flange, said notch of said first flange being located between said second terminal electrode and said second center tap, and said notch of said second flange being located between said first center tap and said third terminal electrode, and a coil including a first wire, a second wire, a third wire and a fourth wire wound around said winding core of said drum core, said first wire including a first end portion connected to said second terminal electrode and a second end portion connected to said first center tap, said second wire including a first end portion connected to said second center tap and a second end portion connected to said third terminal electrode, said third wire including a first end portion connected to said first terminal electrode and a second end portion connected to said first center tap, said fourth wire including a first end portion connected to said second center tap and a second end portion connected to said fourth terminal electrode, and said first and said second wires being wound in a first direction as seen from said first flange toward said winding core and said second flange, and said third and said fourth wires being wound in a second direction as seen from said first flange toward said winding core and said second flange, said first and said fourth wires crossing each other at said inner surface of said first flange, and said second and said third wires crossing each other at said inner surface of said second flange.

2. The pulse transformer as claimed in claim 1, wherein said notch of said first flange is formed through said first flange and formed between said inner and said outer surfaces of said first flange, and said notch of said second flange is formed through said second flange and formed between said inner and said outer surfaces of said second flange.

* * * * *